US012336679B2

(12) United States Patent
Ryan et al.

(10) Patent No.: US 12,336,679 B2
(45) Date of Patent: Jun. 24, 2025

(54) SYSTEMS FOR RACKS IN DISHWASHING APPLIANCES

(71) Applicant: Haier US Appliance Solutions, Inc., Wilmington, DE (US)

(72) Inventors: Justin Daniel Ryan, Louisville, KY (US); Steven Chadwick Koepke, LaGrange, KY (US); Nathaniel Lee Min Sheeran, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 340 days.

(21) Appl. No.: 17/898,549

(22) Filed: Aug. 30, 2022

(65) Prior Publication Data

US 2024/0065517 A1 Feb. 29, 2024

(51) Int. Cl.
*A47L 15/42* (2006.01)
*A47L 15/50* (2006.01)

(52) U.S. Cl.
CPC ..... *A47L 15/4246* (2013.01); *A47L 15/50* (2013.01); *A47L 15/504* (2013.01)

(58) Field of Classification Search
None
See application file for complete search history.

(56) References Cited

U.S. PATENT DOCUMENTS 8,746,467 B2 6/2014 Jeong
2005/0242046 A1 11/2005 Lee
2012/0181242 A1* 7/2012 Jeong ..... A47L 15/502 312/228.1
2019/0298146 A1* 10/2019 Gutkowski ..... A47L 15/502

FOREIGN PATENT DOCUMENTS

CN 202179515 U 4/2012

* cited by examiner

*Primary Examiner* — Levon J Shahinian
(74) *Attorney, Agent, or Firm* — Dority & Manning, P.A.

(57) ABSTRACT

A dishwasher appliance includes a tub defining a wash chamber. A first rack assembly is slidably positioned within the wash chamber. A first spray assembly is positioned in the wash chamber and configured to direct wash fluids at the first rack assembly. A second rack assembly is slidably positioned in the wash chamber above the first rack assembly. A second spray assembly is positioned in the wash chamber and configured to direct wash fluids at the second rack assembly. A third rack assembly is slidably positioned in the wash chamber above the second rack assembly. A third spray assembly is positioned over the third rack assembly and configured to direct wash fluid at articles located in the third rack assembly. The third rack assembly includes a wire framework defining a perimeter of the third rack assembly. A wire insert includes a wire floor portion that is defined between a first boundary wall and a second boundary wall. The first boundary wall and the second boundary wall can removably couple to the wire framework.

18 Claims, 9 Drawing Sheets

SYSTEMS FOR RACKS IN DISHWASHING APPLIANCES

FIELD OF THE INVENTION

The present subject matter relates generally to dishwasher appliances, and more particularly to a dishwasher appliance with a third rack.

BACKGROUND OF THE INVENTION

Dishwasher appliances generally include rack assemblies for positioning various articles for cleaning within a wash chamber. One or more devices, such as nozzles or spray assemblies, may be included at various locations relative to the rack assemblies for purposes of delivering fluids as part of the cleaning process. During the cleaning cycle, the rack assemblies can support and position the articles while also having openings that allow fluid to pass through to the articles. Factors, such as the velocity of the fluid, orientation of the fluid spray or stream relative to the articles, the shape and density of the articles in the rack assemblies, and others, can impact the effectiveness of the cleaning cycle.

One or more rack assemblies may be used in dishwasher appliances for user convenience. Multiple rack assemblies on multiple levels within dishwasher appliances may allow users to place articles of differing heights and sizes in optimal positions to allow for proper cleaning of the articles. Some dishwasher appliances may include one or more baskets which may also be provided for holding articles, particularly smaller or for more narrow articles, such as silverware. Additionally, the user may have the option of, e.g., placing articles, such as silverware, within a basket on a lower rack assembly or placing the silverware directly (without the basket) onto an upper rack assembly specially configured for the receipt of such articles.

The positioning of articles within a dishwasher appliance can affect the fluid dynamics to which the articles are exposed during the cleaning process. For example, articles placed in a lower rack assembly may be subjected to different spray assemblies with different spray patterns, velocities, and spray duration than articles placed in a higher rack assembly. Additionally, the use of multiple racks, such as an upper rack assembly, may limit the size of articles that fit in each rack of the dishwasher appliance. The size of articles that may be placed in a middle rack assembly, for example, may be limited by the addition of an upper rack positioned above the middle rack in the wash chamber.

BRIEF DESCRIPTION OF THE INVENTION

Aspects and advantages of the invention will be set forth in part in the following description, or may be apparent from the description, or may be learned through practice of the invention.

In one example embodiment, a dishwasher appliance includes a tub defining a wash chamber. A first rack assembly is slidably positioned within the wash chamber. A first spray assembly is positioned in the wash chamber and configured to direct wash fluids at the first rack assembly. A second rack assembly is slidably positioned in the wash chamber above the first rack assembly. A second spray assembly is positioned in the wash chamber and configured to direct wash fluids at the second rack assembly. A third rack assembly is slidably positioned in the wash chamber above the second rack assembly. A third spray assembly is positioned over the third rack assembly and configured to direct wash fluid at articles located in the third rack assembly. The third rack assembly includes a wire framework defining a perimeter of the third rack assembly. A wire insert includes a wire floor portion that is defined between a first boundary wall and a second boundary wall. The first boundary wall and the second boundary wall can removably couple to the wire framework.

In another example embodiment, a dishwasher appliance includes a tub defining a wash chamber. A first rack assembly is slidably positioned within the wash chamber. A first spray assembly is positioned in the wash chamber and configured to direct wash fluids at the first rack assembly. A second rack assembly is slidably positioned in the wash chamber above the first rack assembly. A second spray assembly is positioned in the wash chamber and configured to direct wash fluids at the second rack assembly. A third rack assembly is slidably positioned in the wash chamber above the second rack assembly. A third spray assembly is positioned over the third rack assembly and configured to direct wash fluid at articles located in the third rack assembly. The third rack assembly includes a wire framework defining the perimeter of the third rack assembly. A wire insert includes a wire floor portion that is defined between a first boundary wall and a second boundary wall. The first boundary wall and the second boundary wall can removably couple to the wire framework. The wire floor portion of the wire insert includes a raised floor portion and a lower floor portion. The raised floor portion is configured for the receipt of smaller articles than the lower floor portion. The wire framework includes a third boundary wall at a first side portion and a fourth boundary wall at a second side portion of the wire framework.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
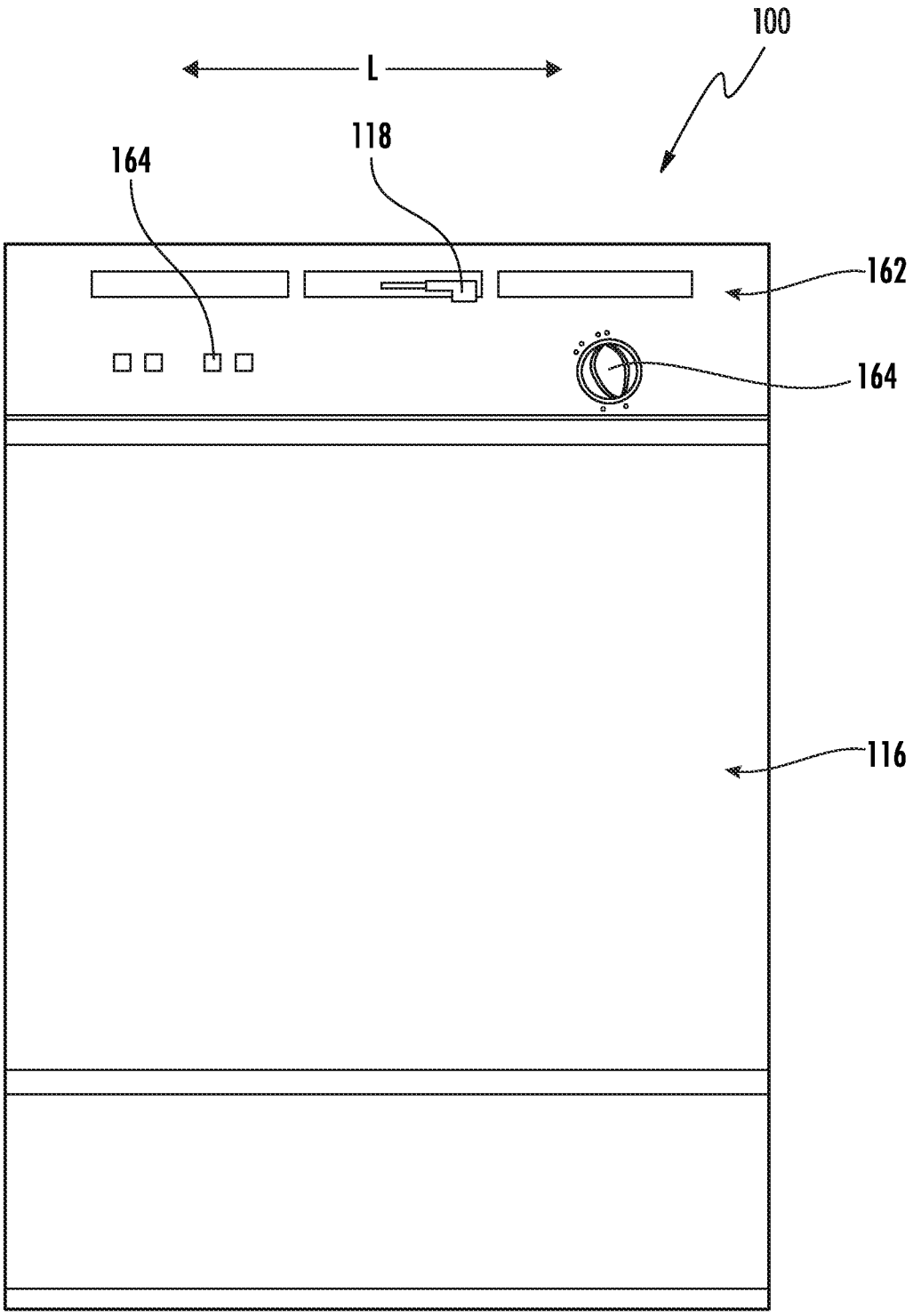
FIG. 1 provides a perspective view of an example embodiment of a dishwashing appliance of the present disclosure.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "cleaning cycle" is intended to refer to one or more periods of time that may include a wash cycle, rinse cycle, and/or a drain cycle. The term "wash fluid" refers to a liquid used for washing and/or rinsing the articles and is typically made up of water that may include other additives such as detergent or other treatments.

Figure 2:
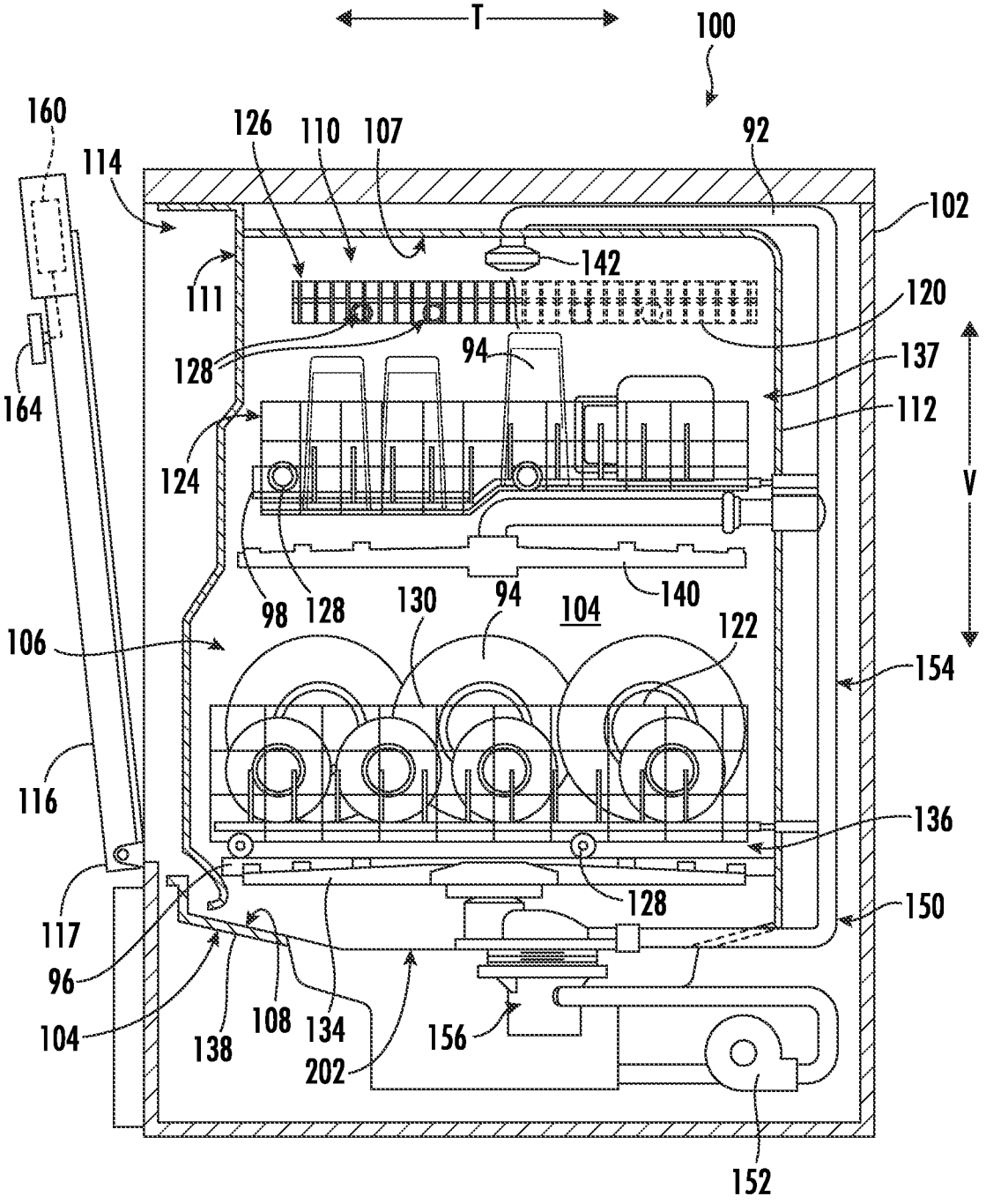
FIG. 2 provides a side, cross sectional view of the example dishwashing appliance of FIG. 1.

FIGS. 1 and 2 depict an example domestic dishwasher or dishwashing appliance 100 that may be configured in accordance with aspects of the present disclosure. For the particular embodiment of FIGS. 1 and 2, the dishwasher appliance 100 includes a cabinet 102 (FIG. 2) having a tub 104 therein that defines a wash chamber 106 for receipt of articles 94 for washing. As shown in FIG. 2, tub 104 extends between a top 107 and a bottom 108 along a vertical direction V, between a pair of opposing side walls 110 along a lateral direction L, and between a front side 111 and a rear side 112 along a transverse direction T. Each of the vertical direction V, lateral direction L, and transverse direction T are mutually perpendicular to one another.

In this regard, as used herein, the terms "cabinet," "housing," and the like are generally intended to refer to an outer frame or support structure for appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of appliance 100. By contrast, cabinet 102 may enclose some or all portions of an interior of cabinet 102. It should be appreciated that cabinet 102 may have any suitable size, shape, and configuration while remaining within the scope of the present subject matter.

The tub 104 includes a front opening 114 and a door 116 hinged at its bottom 117 for movement between a normally closed vertical position (shown in FIG. 1), wherein the wash chamber 106 is sealed shut for washing operation, and a horizontal open position for loading and unloading of articles from the dishwasher appliance 100. According to example embodiments, dishwasher appliance 100 further includes a door closure mechanism or assembly 118 that is used to lock and unlock door 116 for accessing and sealing wash chamber 106.

At least one rack assembly is slidably positioned within wash chamber 106 and is configured for the receipt of articles for cleaning. For the example embodiment shown in FIG. 2, opposing tub sidewalls 110 accommodate a plurality of rack assemblies. More specifically, guide rails 96, 98 and 120 may be mounted to (or formed as part of) sidewalls 110 for supporting a first rack assembly 122 (also referred to as a lower rack assembly 122), a middle rack assembly 124 (also referred to as a second rack assembly 124), and a third rack assembly 126 (also referred to as an upper rack assembly 126). As illustrated, upper rack assembly 126 is positioned at a top portion of wash chamber 106 above middle rack assembly 124, which is positioned above lower rack assembly 122 along the vertical direction V. Additional details regarding the upper rack assembly 126 will be provided herein. For this example embodiment, upper rack assembly 126 is supported on opposing sidewalls 110 by rails 120 but rails 120 could be supported on and attached to middle rack assembly 124 as well.

Each rack assembly 122, 124, 126 is adapted for movement along transverse direction T between an extended loading position (not shown) in which the rack is substantially positioned outside the wash chamber 106, and a retracted position (shown in FIGS. 1 and 2) in which the rack is located inside the wash chamber 106. This may be facilitated, for example, by rollers, or guide wheels 128 mounted onto rack assemblies 122, 124, 126, respectively. Although guide rails 96, 98, 120 and guide wheels 128 are illustrated herein as facilitating movement of the respective rack assemblies 122, 124, 126, it should be appreciated that any suitable sliding mechanism or member may be used according to alternative embodiments. In some embodiments, dishwasher appliance 100 may accommodate a different number of rack assemblies and supporting guide rails. For example, dishwasher appliance 100 may accommodate only first rack assembly 122 and upper rack assembly 126, with accompanying guide rails.

Some or all of the rack assemblies 122, 124, 126 may be fabricated into lattice, or grid, structures including a plurality of wires or elongated members 130 (for clarity of illustration, not all elongated members making up rack assemblies 122, 124, 126 are shown in FIG. 2). The plurality of wires or elongated members 130 may be either steel and stainless steel, and the wire may be coated with none, one, or more of nylon and polyvinyl chloride. Rack assemblies 122, 124, 126 are generally configured for supporting articles 94 within wash chamber 106 while allowing a flow of wash fluid to reach and impinge on those articles, e.g., during a cleaning or rinsing cycle. For some embodiments, a silverware basket (not shown) is removably attached to a rack assembly, e.g., lower rack assembly 122, for placement of silverware, utensils, and the like, that are otherwise too small or delicate to be accommodated by rack 122.

At least one spray assembly is located in wash chamber 106 and is configured to direct wash fluids onto at least on rack assembly for washing articles located therein. For the example embodiment of FIG. 2, dishwasher appliance 100 further includes a plurality of spray assemblies for urging a flow of water or wash fluid onto the articles placed within wash chamber 106. More specifically, as illustrated in FIG. 2, dishwasher appliance 100 includes a first spray assembly 134 (also referred to as a lower spray arm assembly 134) disposed in a lower region 136 of wash chamber 106 and above a sump 138 so as to rotate in relatively close proximity to lower rack assembly 122. Similarly, a second spray assembly 140 (also referred to as a mid-level spray arm assembly 140) is located in an upper region 137 of wash chamber 106 and may be located below and in close proximity to middle rack assembly 124. In this regard, mid-level spray arm assembly 140 may generally be configured for urging a flow of wash fluid up through middle rack assembly 124 and third rack assembly 126. Additionally, an upper or third spray assembly 142 (also referred to as an upper spray assembly 142) may be located above upper or third rack assembly 126 along the vertical direction V. In this manner, third spray assembly 142 may be configured for urging and/or cascading a flow of wash fluid downward over rack assemblies 122, 124, and 126.

The various spray assemblies and manifolds described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds. For example, as illustrated in FIG. 2, a primary supply conduit 154 may extend from pump 152, along rear side 112 of tub 104 along the vertical direction V to supply wash fluid throughout wash chamber 106. In some examples, a secondary supply conduit (not shown) may supply additional wash fluid to one or more various spray assemblies and manifolds.

As illustrated, primary supply conduit 154 is used to supply wash fluid to mid-level spray arm assembly 140 while a secondary supply conduit 92 supplies wash fluid to upper spray assembly 142. Diverter assembly 156 can allow selection between spray assemblies 134 and 140, 142 being supplied with wash fluid. However, it should be appreciated that according to alternative embodiments, any other suitable plumbing configuration may be used to supply wash fluid throughout the various spray manifolds and assemblies described herein.

Each spray assembly 134, 140, 142 or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray assemblies 134, 140, 142 may be motor-driven, or may operate using any other suitable drive mechanism. Spray manifolds and assemblies may also be stationary. Movement of the spray arm assemblies 134 and 140 and the spray from fixed manifolds like spray assembly 142 provides coverage of dishes, silverware, and other dishwasher contents and articles 94 to be cleaned with a washing spray. Other configurations of spray assemblies may be used as well. For example, dishwasher appliance 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber (not shown) for selectively distributing the wash fluid to the spray assemblies 134, 140, 142 and/or other spray manifolds or devices. For example, the diverter disk may have a plurality of apertures that are configured to align with one or more outlet ports (not shown) at the top of diverter chamber (not shown). In this manner, the diverter disk may be selectively rotated to provide wash fluid to the desired spray device.

According to an example embodiment, diverter assembly 156 is configured for selectively distributing the flow of wash fluid from pump 152 to various fluid supply conduits, only some of which (e.g., 154) are illustrated in FIG. 2 for clarity. More specifically, diverter assembly 156 may include four outlet ports (not shown) for supplying wash fluid to a first conduit for rotating lower spray arm assembly 134 in the clockwise direction, a second conduit for rotating lower spray arm assembly 134 in the counterclockwise direction, a third conduit for spraying rack assembly 126 (shown in FIG. 2) as a silverware rack, and a fourth conduit for supplying only mid-level and/or upper spray assemblies 140, 142. Other configurations of diverter assembly 156 and/or other components (e.g., valves) may be used to allow various choices in the operation of the spray assemblies 134, 140, and 142 during a cleaning cycle.

The dishwasher appliance 100 is further equipped with a controller 160 (FIG. 2) to regulate operation of the dishwasher appliance 100. Controller 160 may include one or more memory devices and one or more microprocessors, such as general or special purpose microprocessors operable to execute programming instructions or micro-control code associated with a cleaning cycle. The memory may represent random access memory such as DRAM or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher appliance 100. In the illustrated embodiment, the controller 160 may be located within a control panel area 162 of door 116. In such an embodiment, input/output ("I/O") signals may be routed between the control system and various operational components of dishwasher appliance 100 along wiring harnesses that may be routed through the bottom of door 116. Typically, the controller 160 includes a user interface panel/controls 164 (FIG. 1) through which a user may select various operational features and modes and monitor progress of the dishwasher appliance 100. In one embodiment, the user interface 164 may represent a general purpose I/O ("GPIO") device or functional block. In one embodiment, the user interface 164 may include input components, such as one or more of a variety of electrical, mechanical, or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher appliance 100. The example embodiment depicted in FIGS. 1 and 2 is for illustrative purposes only. For example, different locations may be provided for user interface 164, different configurations, including providing one or more rack assemblies 122, 124, 126 and one or more spray assemblies 134, 140, 142, to dishwasher appliance 100 may be used, different configurations may be provided for rack assemblies 122, 124, 126, different spray assemblies 134, 140, 142 and spray manifold configurations may be used, and other differences may be applied while remaining within the scope of the present subject matter.

Figure 3:
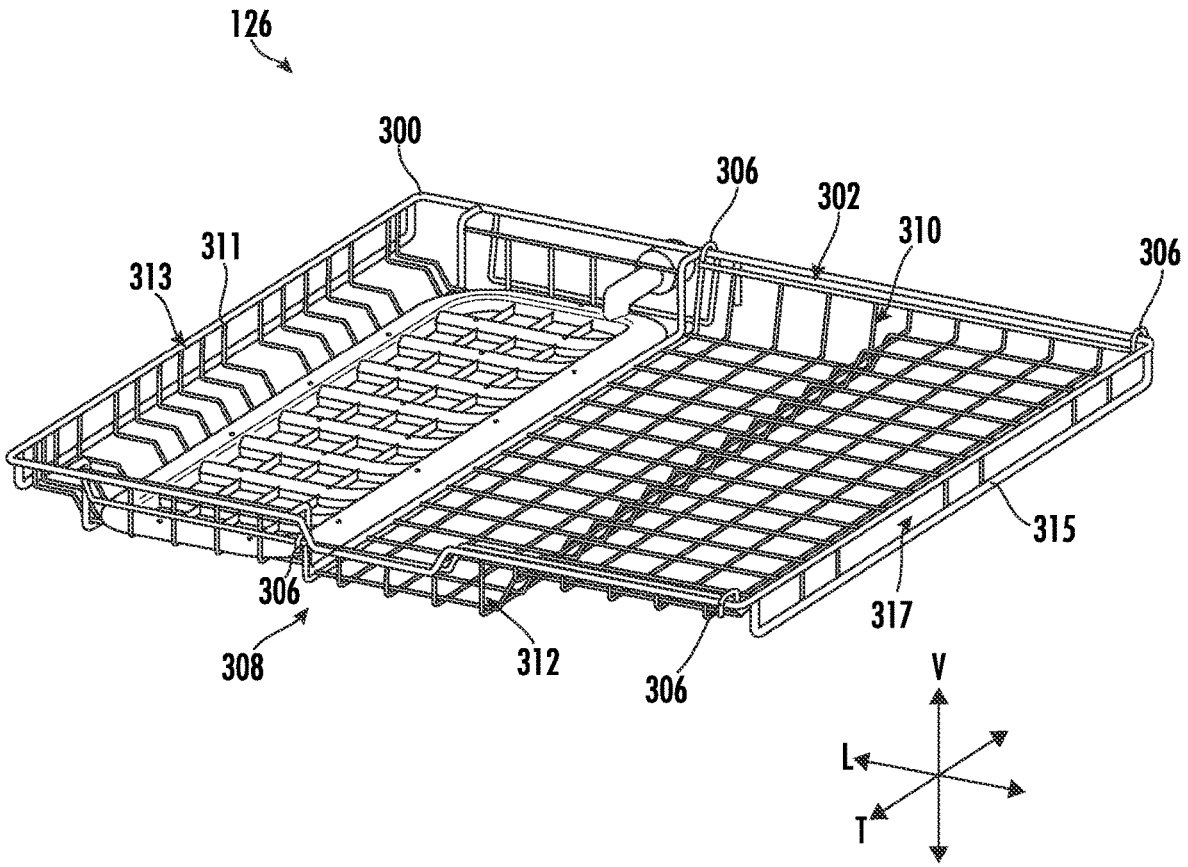
FIG. 3 provides a perspective view of an example embodiment of a rack of the dishwashing appliance of FIG. 1.
Figure 4:
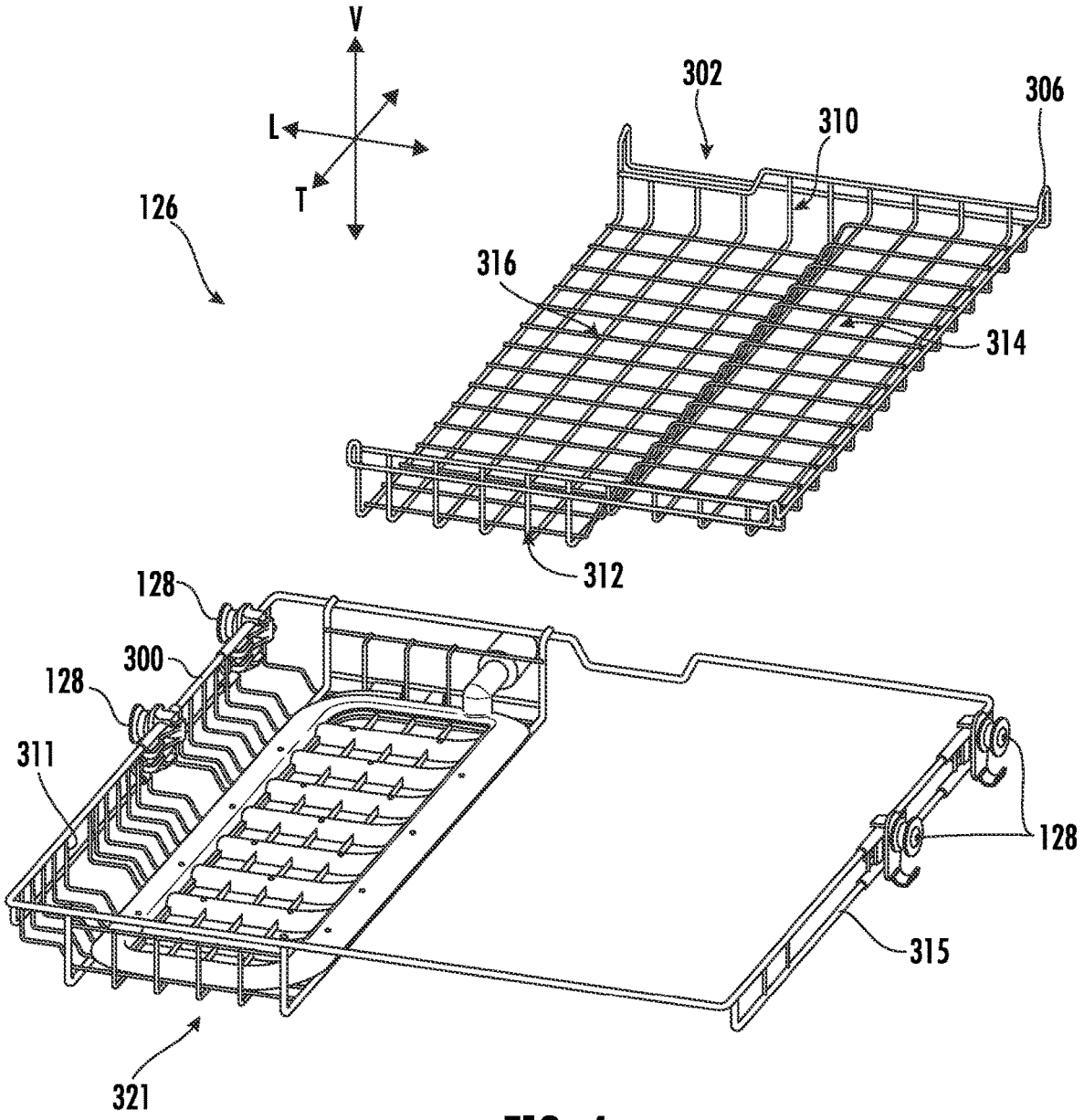
FIG. 4 provides a perspective view of the example rack of FIG. 3 with a wire insert removed from the rack.

Shown in FIGS. 3 and 4, the perimeter of third rack assembly 126 may be defined by a wire framework 300. Wire framework 300 may include a floor 308 formed in combination with the floor portion of wire insert 302. Wire insert 302 may include at least two (2) of a hook 306, or the like, for removably coupling wire insert 302 to wire framework 300. The present example embodiment includes four (4) hooks 306. Wire insert 302 may be defined in the transverse direction T, between a first boundary wall 310 and a second boundary wall 312, whereupon hooks 306 may be positioned. In FIG. 3, wire insert 302 is shown coupled to wire framework 300 via hooks 306. In FIG. 4, wire insert 302 is shown removed from wire framework 300 with respect to the vertical direction V. Wire insert 302 may include an upper floor portion 314 and a lower floor portion 316. The upper floor portion 314 and the lower floor portion 316 may be positioned at different heights with respect to the vertical direction V such that different size articles for washing may be placed upon wire insert 302. Lower floor portion 316 may be configured to interface, e.g., minimal gap, with floor 308 when wire insert 302 is inserted in wire framework 300. Thus, e.g., floor 308 may be nested against wire insert 302 when wire insert 302 is inserted in wire framework 300. Moreover, lower floor portion 316 may be positioned generally coplanar with floor 308 such that lower floor portion 316 and floor 308 may collectively form a portion of the floor of third rack assembly 126.

Referring still to FIGS. 3 and 4, wire framework 300 may further include a third boundary wall 311 at a first side portion 313 and a fourth boundary wall 315 at a second side portion 317. Third boundary wall 311 at first side portion 313 and fourth boundary wall 315 at second side portion 317 may be configured for enclosing third rack assembly 126 with respect to the lateral direction L. First boundary wall 310 and second boundary wall 312 of wire insert 302 may enclose third rack assembly 126 with respect to the transverse direction T.

Figure 5:
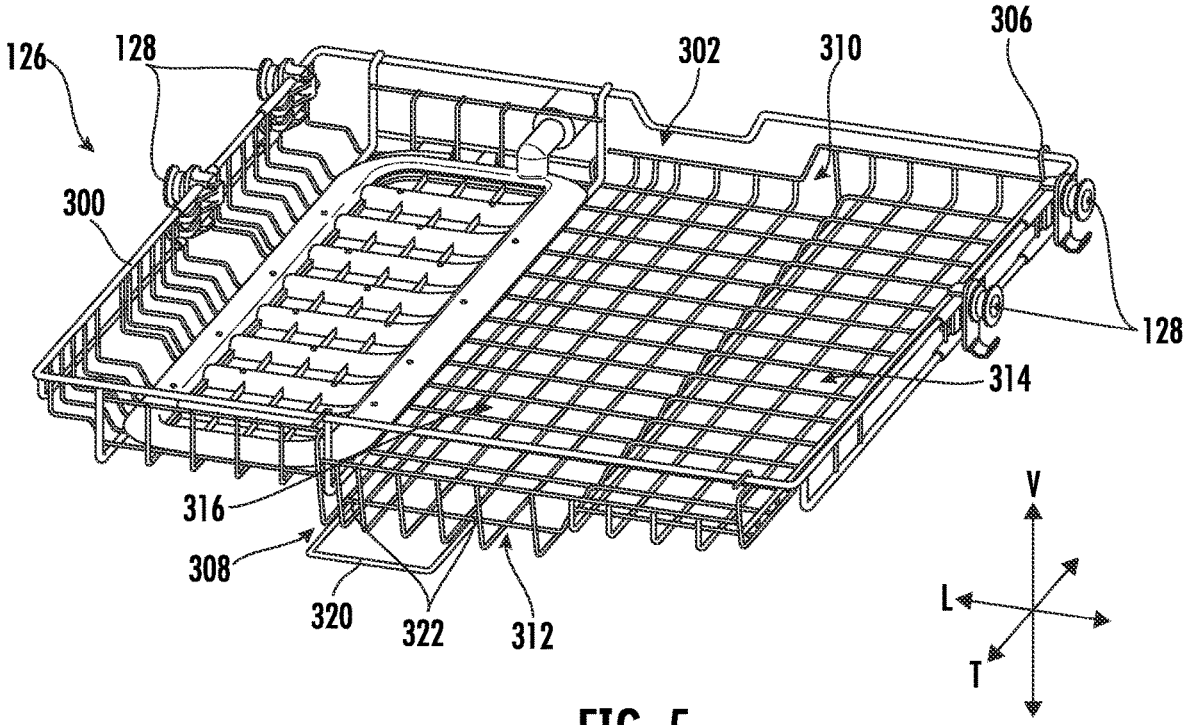
FIG. 5 provides a perspective view of an example embodiment of a rack of the dishwashing appliance of FIG. 1.
Figure 6:
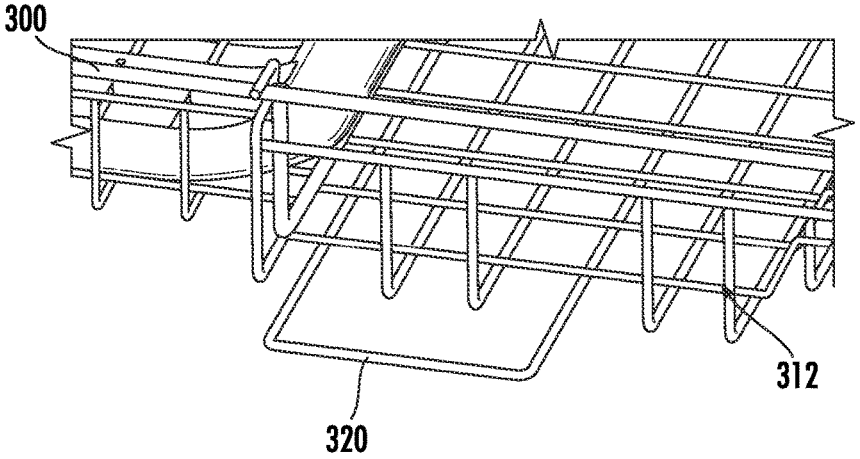
FIG. 6 provides a perspective view of an example embodiment of a handle on the rack of FIG. 5.
Figure 7:
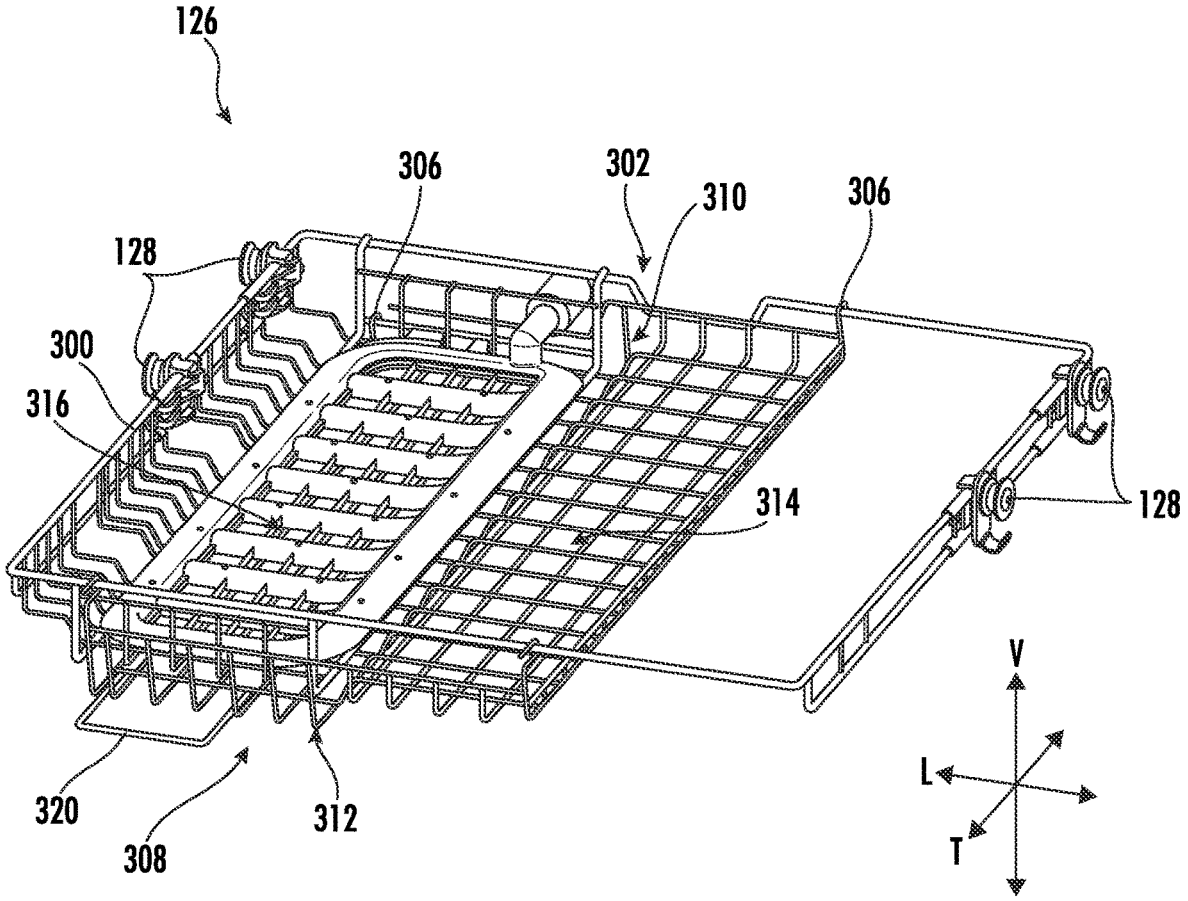
FIG. 7 provides a perspective view of the example rack of FIG. 5 with the wire insert in a translated position.

Shown in FIGS. 5-7, another example embodiment of third rack assembly 126 may be defined by a wire framework 300. Wire framework 300 may include a floor 308 and a wire insert 302 forming a first floor portion and a second floor portion, respectively, of a floor of third rack assembly 126. Wire insert 302 may include at least two (2) of a hook 306, or the like, for coupling wire insert 302 to wire framework 300. The present example embodiment includes four (4) hooks 306. Wire insert 302 may be defined in the transverse direction T, between a first boundary wall 310 and a second boundary wall 312, whereupon hooks 306 may be positioned. Wire insert 302 may include an upper floor portion 314 and a lower floor portion 316. The upper floor portion 314 and the lower floor portion 316 may be positioned at different heights with respect to the vertical direction, V, such that different size articles for washing may be placed upon wire insert 302.

As discussed in greater detail below, wire insert 302 may be translatable relative to wire framework 300, e.g., along the lateral direction L. For example, hooks 306 may slide on wires of wire framework 300 as wire insert 302 translates relative to wire framework 300, e.g., along the lateral direction L. As an example, wire insert 302 may be translatable relative to wire framework 300 between the positions shown in FIGS. 5 and 7. A user may adjust the position of wire insert 302 on wire framework 300 in order to allow taller items to be placed on a rack (not shown) below third rack assembly 126 with interfering with wire insert 302.

Lower floor portion 316 may include a handle 320 welded to the wires of lower floor portion 316 at weld spots 322. Handle 320 may extend in the transverse direction T. FIG. 6 provides an alternative embodiment of handle 320, where handle 320 is a continuation of the existing wire of lower floor portion 316, rather than an additional, welded handle piece. As illustrated in FIG. 7, a user may grasp handle 320 and translate wire insert 302 along the lateral direction L. Additional or alternative embodiments may exist where a user may grasp handle 320 and translate wire insert 302 along the transverse direction T. Handle 320 may show a user the intended translation of third rack assembly 126, e.g., perpendicular or parallel to tub 104. Third rack assembly 126 may be perceived as shallow and hidden at the top of dishwasher appliance 100, so handle 320 may aid in communicating to a user the location of third rack assembly 126 when viewing dishwasher appliance 100 from above. Additionally or alternatively, wire insert 302 may include both handles 320 that extend in the transverse direction T and vertical direction V.

Figure 8:
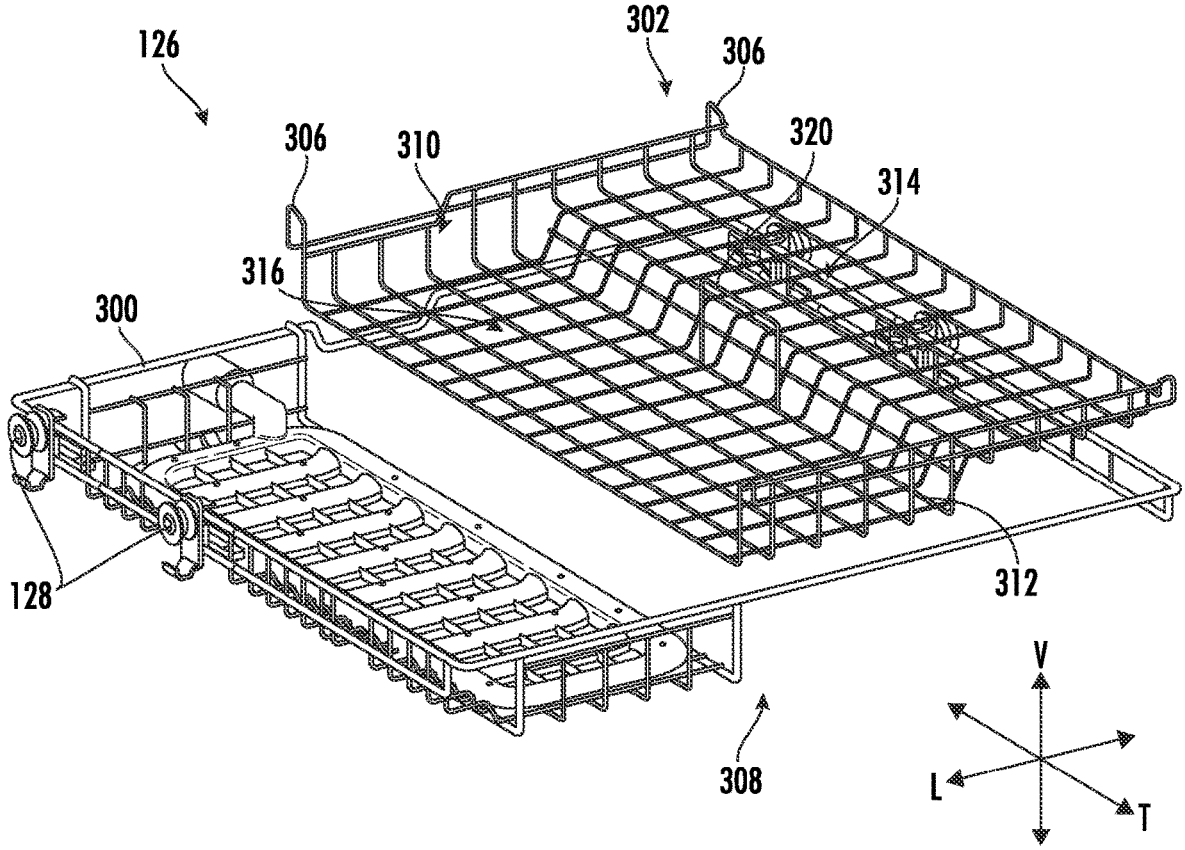
FIG. 8 provides a perspective view of an example embodiment of a rack of the dishwashing appliance of FIG. 1.

Shown in FIG. 8 is another example embodiment of third rack assembly 126 combining elements from other example embodiments. Particularly, wire insert 302 may include at least two (2) of a hook 306, or the like, for removably coupling wire insert 302 to wire framework 300. The present example embodiment includes four (4) hooks 306. Wire insert 302 is shown removed from wire framework 300 with respect to the vertical direction V in FIG. 8. A handle 320 may be welded or bent from lower floor portion 316 and extend in the vertical direction, V, such that a user may grasp handle 320 and lift wire insert 302 in the vertical direction V out from wire framework 300.

Figure 9:
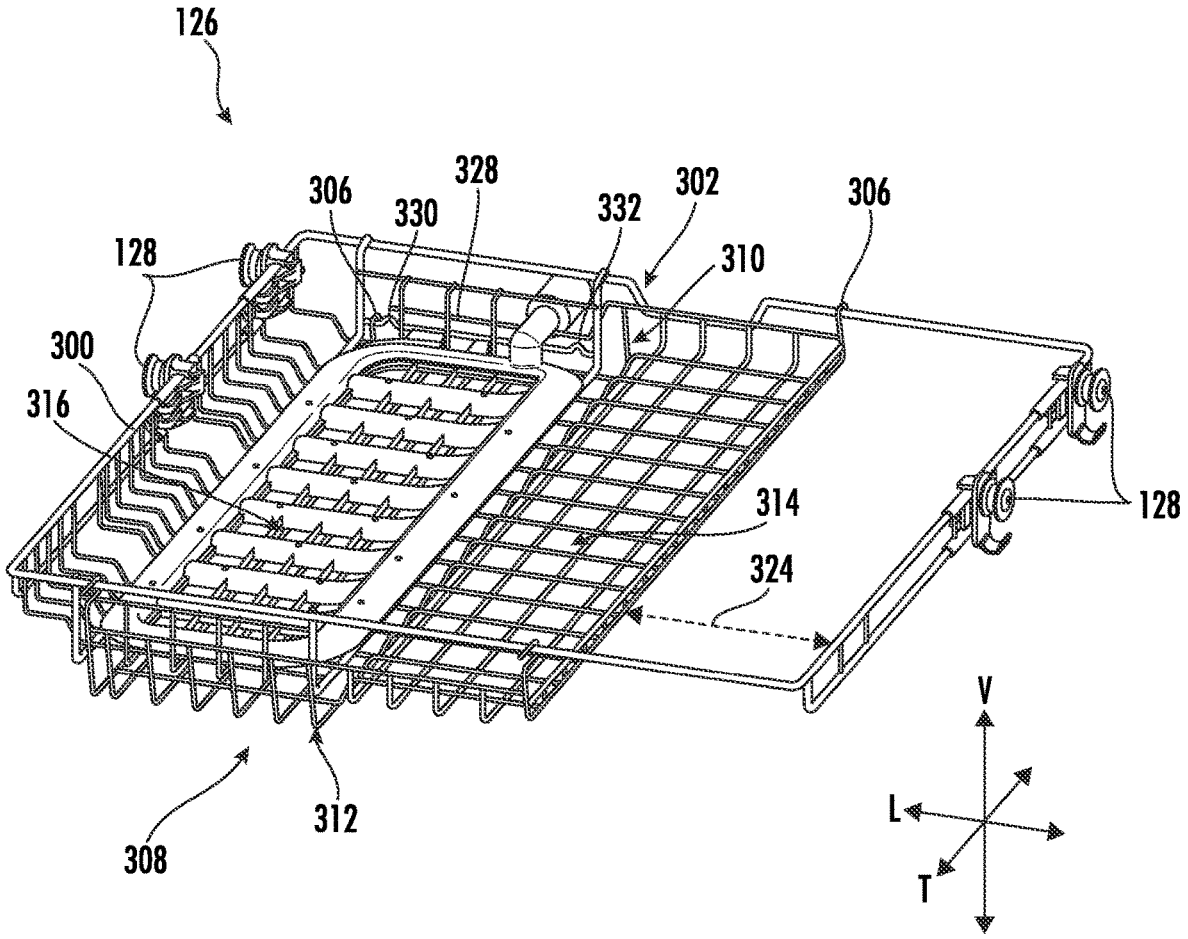
FIG. 9 provides a perspective view of an example embodiment of a rack of the dishwashing appliance of FIG. 1.

Shown in FIG. 9, another example embodiment of third rack assembly 126 may be defined by a wire framework 300. In the present example embodiment, wire framework 300 may include a guide bar 328 across which wire insert 302 translates via hook 306. Wire insert 302 may change position relative to the wire framework 300. As shown in FIG. 9, a first detent 330 may be positioned at an end of guide bar 328 and a second detent 332 may be positioned at an opposite end of guide bar 328. First detent 330 may provide tactile feedback to a user translating wire insert 302 when a gap 324 has been fully opened, e.g., wire insert 302 may be in an open position. First detent 330 may indicate the full justification of wire insert 302 in the open position. Second detent 332 may provide tactile feedback to a user translating wire insert 302 when gap 324 has been fully closed, e.g., wire insert 302 may be in a normal position. Second detent 332 may indicate the full justification of wire insert 302 in the normal position. As shown in FIG. 9, gap 324 is open while wire insert 302 is in the open position. When wire insert 302 is in the normal position, third rack assembly 126 may be closed off from second rack assembly 124, and while wire insert 302 is in the open position, gap 324 of third rack assembly 126 maybe open above second rack assembly 124 in order to fit larger articles for washing.

Figure 10:
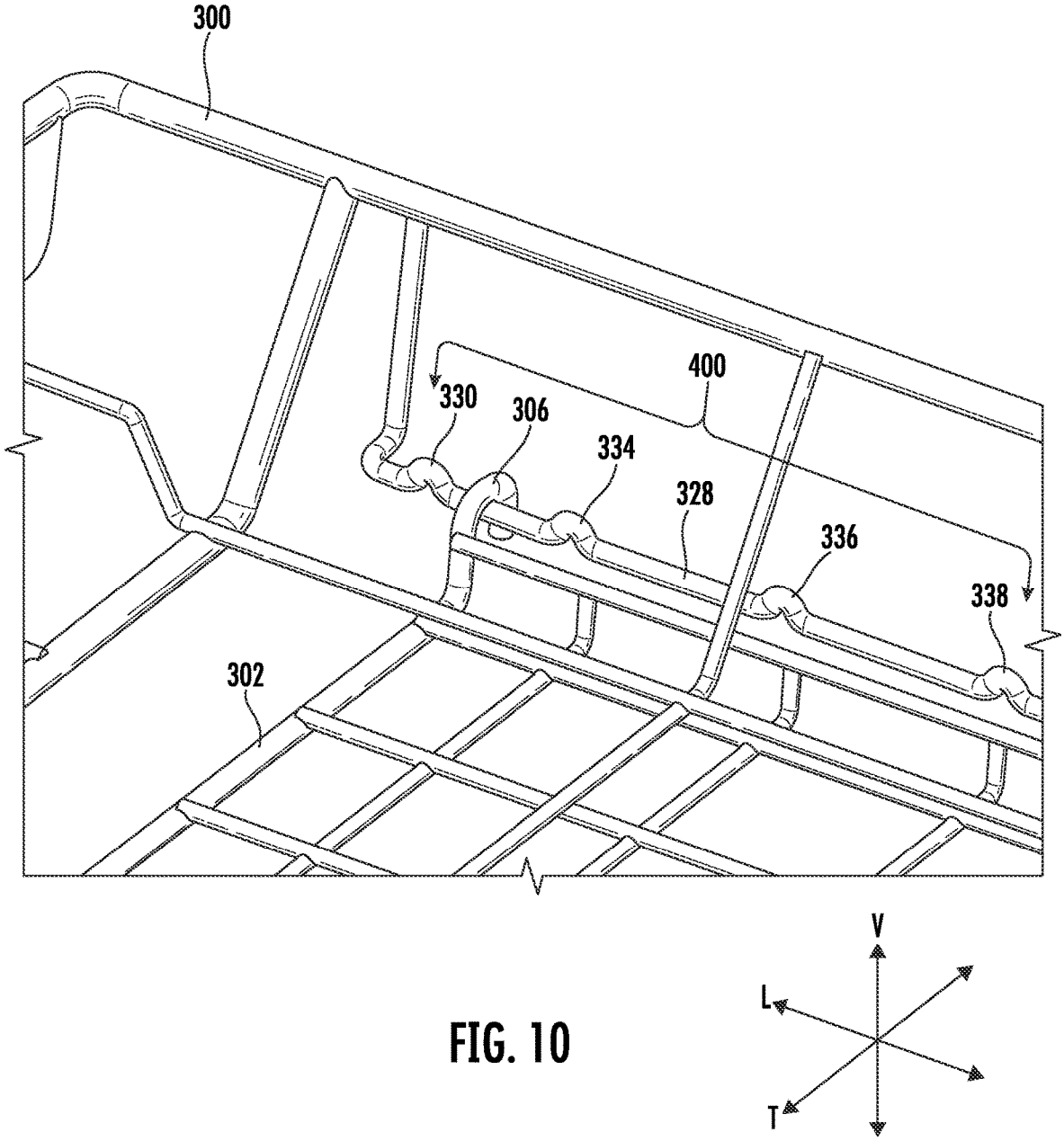
FIG. 10 provides a perspective view of an example embodiment of the rack of FIG. 9.

FIG. 10 provides an example embodiment of the guide bar 328 of FIG. 9, further including a plurality of detents 400 including first detent 330, detent 334, detent 336, and detent 338 and second detent 332 (not shown in FIG. 10). The plurality of detents 400 may indicate different positions of wire insert 302 and the size of gap 324. Wire rack 302 may be positioned between the plurality of detents 400 in order to clear common items in second rack assembly 124 without unnecessarily sacrificing space of third rack assembly 126. For example, a narrow bottle may not need wire insert 302 translated over as much as a wider bottle such as a tumbler. Thus, guide bar 328 of wire framework 300 may have several set points via the plurality of detents 400, such as set points for wide tumblers, stemware, narrow water bottles, etc.

The example embodiments represented in FIGS. 3-10 may be used in any suitable combination thereof. The present example embodiments are provided by way of example only and are not intended to be limiting to the illustrated example embodiments appearance or structure. This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a first rack assembly slidably positioned within the wash chamber;

a first spray assembly positioned in the wash chamber and configured to direct wash fluids at the first rack assembly;

a second rack assembly slidably positioned in the wash chamber above the first rack assembly;

a second spray assembly positioned in the wash chamber and configured to direct wash fluids at the second rack assembly;

a third rack assembly slidably positioned in the wash chamber above the second rack assembly; and a third spray assembly positioned over the third rack assembly and configured to direct wash fluid at articles located in the third rack assembly, the third rack assembly comprising a wire framework defining a perimeter of the third rack assembly, and a wire insert comprising a wire floor portion defined between a first boundary wall and a second boundary wall, the first boundary wall and the second boundary wall removably coupled to the wire framework, the wire insert further comprising a first wire handle extending in the transverse direction from the wire floor portion and a second wire handle extending in the vertical direction from the wire floor portion.

2. The dishwashing appliance of claim 1, wherein the first boundary wall and the second boundary wall each comprises at least one hook to removably couple the wire insert to the wire framework.

3. The dishwashing appliance of claim 1, wherein the wire floor portion of the wire insert comprises a grid pattern of wire, the grid pattern comprises wires extending along a transverse direction and wires extending along a lateral direction.

4. The dishwashing appliance of claim 3, wherein the wires in the grid pattern comprise one or both of coated steel wires and stainless steel wires.

5. The dishwashing appliance of claim 1, wherein the wire framework comprises a third boundary wall at a first side portion of the wire framework and a fourth boundary wall at a second side portion of the wire framework.

6. The dishwashing appliance of claim 5, wherein the third boundary wall at the first side portion of the wire framework and the fourth boundary wall at the second side portion of the wire framework are configured for enclosing the third rack assembly with respect to the lateral direction.

7. The dishwashing appliance of claim 5, wherein the wire framework comprises a wire floor portion extending transversely along a transverse direction, the floor portion extending along the lateral direction between the first side portion and an edge of the wire insert.

8. The dishwashing appliance of claim 5, further comprising a plurality of guide wheels disposed on the third boundary wall at the first side portion of the wire framework and the fourth boundary wall at the second side portion of the wire framework, the plurality of guide wheels configured for sliding the third rack assembly in the transverse direction into and out of the tub of the dishwashing appliance.

9. The dishwashing appliance of claim 1, wherein the first boundary wall and the second boundary wall of the wire insert enclose the third rack assembly with respect to a transverse direction.

10. The dishwashing appliance of claim 1, wherein the wire floor portion of the wire insert comprises an upper floor portion and a lower floor portion, the upper floor portion positioned above the lower floor portion.

11. A dishwasher appliance, comprising:

a tub defining a wash chamber;

a first rack assembly slidably positioned within the wash chamber;

a first spray assembly positioned in the wash chamber and configured to direct wash fluids at the first rack assembly;

a second rack assembly slidably positioned in the wash chamber above the first rack assembly;

a second spray assembly positioned in the wash chamber and configured to direct wash fluids at the second rack assembly;

a third rack assembly slidably positioned in the wash chamber above the second rack assembly; and a third spray assembly positioned over the third rack assembly and configured to direct wash fluid at articles located in the third rack assembly, the third rack assembly comprising, a wire framework defining a perimeter of the third rack assembly, a wire insert that comprises a wire floor portion defined between a first boundary wall and a second boundary wall, the first boundary wall and the second boundary wall removably couple to the wire framework, the wire floor portion of the wire insert comprises a raised floor portion and a lower floor portion, the raised floor portion configured for receipt of smaller articles than the lower floor portion, wherein the wire insert comprises a first wire handle extending in the transverse direction from the wire floor portion and a second wire handle extending in the vertical direction from the wire floor portion, and wherein the wire framework comprises a third boundary wall at a first side portion and a fourth boundary wall at a second side portion of the wire framework.

12. The dishwashing appliance of claim 11, wherein the first boundary wall and the second boundary wall each comprises at least one hook to removably couple the wire insert to the wire framework.

13. The dishwashing appliance of claim 11, wherein the wire floor portion of the wire insert comprises a grid pattern of wire, the grid pattern comprises wires extending along a transverse direction and wires extending along a lateral direction.

14. The dishwashing appliance of claim 13, wherein the wires in the grid pattern comprise one or both of coated steel wires and stainless steel wires.

15. The dishwashing appliance of claim 11, wherein the third boundary wall at the first side portion of the wire framework and the fourth boundary wall at the second side portion of the wire framework are configured for enclosing the third rack assembly with respect to the lateral direction.

16. The dishwashing appliance of claim 11, wherein the first boundary wall and the second boundary wall of the wire insert enclose the third rack assembly with respect to a transverse direction.

17. The dishwashing appliance of claim 11, wherein the wire floor portion of the wire insert comprises an upper floor portion and a lower floor portion, the upper floor portion positioned above the lower floor portion.

18. The dishwashing appliance of claim 11, further comprising a plurality of guide wheels disposed on the third boundary wall at the first side portion of the wire framework and the fourth boundary wall at the second side portion of the wire framework, the plurality of guide wheels configured for sliding the third rack assembly in the transverse direction into and out of the tub of the dishwashing appliance.

* * * * *